US011215189B2

(12) United States Patent
Yan et al.

(10) Patent No.: US 11,215,189 B2
(45) Date of Patent: Jan. 4, 2022

(54) METHOD FOR DESIGNING AN IMPELLER WITH A SMALL HUB-TIP RATIO AND A RIM-DRIVEN PUMP OBTAINED BY THE METHOD

(71) Applicant: HEFEI UNIVERSITY OF TECHNOLOGY, Hefei (CN)

(72) Inventors: Hao Yan, Hefei (CN); Qiang Li, Hefei (CN); Xiaozhen Su, Hefei (CN); Yu Zhang, Hefei (CN); Liang Chen, Hefei (CN); Liping Chai, Hefei (CN); Haixia Shi, Hefei (CN)

(73) Assignee: HEFEI UNIVERSITY OF TECHNOLOGY, Hefei (CN)

( * ) Notice: Subject to any disclaimer, the term of this patent is extended or adjusted under 35 U.S.C. 154(b) by 6 days.

(21) Appl. No.: 16/976,029

(22) PCT Filed: Aug. 21, 2019

(86) PCT No.: PCT/CN2019/101755

§ 371 (c)(1),
(2) Date: Aug. 26, 2020

(87) PCT Pub. No.: WO2020/134126

PCT Pub. Date: Jul. 2, 2020

(65) Prior Publication Data

US 2021/0364005 A1 Nov. 25, 2021

(30) Foreign Application Priority Data

Dec. 29, 2018 (CN) ..... 201811646954.4

(51) Int. Cl.

| | |
|---|---|
| ***F04D 29/18*** | (2006.01) |
| ***F04D 29/52*** | (2006.01) |
| *F04D 3/00* | (2006.01) |

(52) U.S. Cl.
CPC ..... *F04D 29/181* (2013.01); *F04D 29/528* (2013.01); *F04D 3/00* (2013.01)

(58) Field of Classification Search
None
See application file for complete search history.

(56) References Cited

FOREIGN PATENT DOCUMENTS

| | | | |
|---|---|---|---|
| CN | 105805043 A | * | 7/2016 |
| JP | 2012149649 A | * | 8/2012 |

OTHER PUBLICATIONS

Luoxingyi, machine translation of CN 105805043, published Jul. 27, 2016 (Year: 2016).*

(Continued)

*Primary Examiner* — Michael Lebentritt
*Assistant Examiner* — Jason G Davis
(74) *Attorney, Agent, or Firm* — Bayramoglu Law Offices LLC

(57) ABSTRACT

A method for designing an impeller with a small hub-tip ratio includes the following steps: S1: obtaining an outer diameter D of the impeller with the small hub-tip ratio; S2: determining the number of blades and an airfoil of the blade of the impeller with the small hub-tip ratio; S3: obtaining a blade solidity $s_y$ at a rim of the impeller with the small hub-tip ratio and a blade solidity $s_g$ at a hub of the impeller with the small hub-tip ratio; S4: dividing the blades of the impeller with the small hub-tip ratio into m cylindrical sections in an equidistant manner, marking the cylindrical sections as 1-1, 2-2, . . . , m-m in sequence from the hub to the rim, and obtaining an airfoil setting angle $\beta_L$ of each of the cylindrical sections; and S5: performing a correction on the value of the airfoil setting angle $\beta_L$ in S4.

14 Claims, 4 Drawing Sheets

(56) References Cited

OTHER PUBLICATIONS

Ikeda, Akio, machine translation of JP 2012149679, published Aug. 9, 2012 (Year: 2012).*

* cited by examiner

METHOD FOR DESIGNING AN IMPELLER WITH A SMALL HUB-TIP RATIO AND A RIM-DRIVEN PUMP OBTAINED BY THE METHOD

CROSS REFERENCE TO THE RELATED APPLICATIONS

This application is the national phase entry of International Application No. PCT/CN2019/101755, filed on Aug. 21, 2019, which is based upon and claims priority to Chinese Patent Application No. 201811646954.4, filed on Dec. 29, 2018, the entire contents of which are incorporated herein by reference.

TECHNICAL FIELD

The present invention belongs to the technical field of drive pumps, and more particularly, relates to a method for designing an impeller with a small hub-tip ratio and a rim-driven pump obtained by the method.

BACKGROUND

Traditional impellers typically have a hub-tip ratio ranging from 0.3 to 0.6. The rotational torque of the structural design of an impeller starts from the hub, which cannot exploit the characteristics and advantages of the impeller of a rim-driven pump. An impeller with a small hub-tip ratio and a reasonable structure cannot be produced by traditional design methods. A definitive and easy-to-operate method for designing structurally reasonable impellers suitable for rim-driven pumps, however, remains absent in the prior art.

SUMMARY

In order to solve the above-mentioned problems, an objective of the present invention is to provide a method for designing an impeller with a small hub-tip ratio and a rim-driven pump obtained by the method. The impeller obtained by this method has a small hub-tip ratio ranging from 0.1 to 0.3, and is structurally reasonable and exhibits excellent hydraulic performance.

The present invention provides the following technical solutions.

A method for designing an impeller with a small hub-tip ratio includes the following steps:

S1: obtaining an outer diameter D of the impeller with the small hub-tip ratio;

S2: determining the number of blades and an airfoil of the blade of the impeller with the small hub-tip ratio;

S3: obtaining a blade solidity $s_y$ at a rim of the impeller with the small hub-tip ratio and a blade solidity $s_g$ at a hub of the impeller with the small hub-tip ratio;

S4: dividing the blades of the impeller with the small hub-tip ratio into m cylindrical sections in an equidistant manner, marking the cylindrical sections as 1-1, 2-2, . . . , m-m in sequence from the hub to the rim, and obtaining an airfoil setting angle $\beta_L$ of each of the cylindrical sections;

S5: performing a correction on the value of the airfoil setting angle $\beta_L$ in S4;

S6: determining a thickness of the blade of the impeller with the small hub-tip ratio;

S7: building a model according to the parameters of the impeller with the small hub-tip ratio obtained in S1-S6, and performing a numerical simulation on the built impeller model to obtain a simulated head value; wherein if the simulated head value is within a designed head value range, the design of the impeller with the small hub-tip ratio is completed; and if the simulated head value is outside the designed head value range, returning to S1 to recalculate until the simulated head value is within the designed head value range.

Preferably, S1 specifically includes the following steps:

S11: obtaining an estimated value $D_{estimated\ value}$ of the outer diameter of the impeller with the small hub-tip ratio by the following formula:

$$D_{estimated\ value} = \frac{60}{n\pi}\left(\frac{n_s}{586} + 0.8\right)\sqrt{2gH};$$

wherein, n represents a motor speed, π represents the ratio of a circle's circumference to its diameter, $n_s$ represents a specific speed of a rim-driven pump, and H represents a head;

S12: obtaining a diameter d of the hub of the impeller with the small hub-tip ratio by the following formula:

$$d = R_d * D_{estimated\ value};$$

wherein, $R_d$ represents the hub-tip ratio, and $D_{estimated\ value}$ represents the estimated value of the outer diameter of the impeller with the small hub-tip ratio obtained in S11;

S13: obtaining an actual value D of the outer diameter of the impeller with the small hub-tip ratio by the following formula:

$$D = \sqrt{\frac{\left(4Q + 0.07\pi d^2\sqrt[3]{Qn^2}\right)}{\left(0.07\pi\sqrt[3]{Qn^2}\right)}};$$

wherein, Q represents a flow rate, n represents the motor speed, n represents the ratio of a circle's circumference to its diameter, and d represents the diameter of the hub of the impeller with the small hub-tip ratio obtained in S12.

Preferably, the number of blades in S2 is 3-5, and the airfoil of the blade is a National Advisory Committee for Aeronautics (NACA) series airfoil.

The actual value D of the outer diameter of the impeller with the small hub-tip ratio obtained in S13 is checked by the following formula:

$$D_{check} = 1 - \frac{D}{D_{estimated\ value}}.$$

If $D_{check}$ is within the range of 0.1-0.3, $D_{check}$ belongs to the range of the small hub-tip ratio. If $D_{check}$ is outside the range of 0.1-0.3, the outer diameter D of the impeller with the small hub-tip ratio is recalculated and obtained by S11-S13.

Preferably, S3 specifically includes the following steps:

S31: obtaining the blade solidity $s_y$ at the rim by the following formula:

$$s_y = 6.1751k + 0.01254;$$

wherein, $$k = -5.0162\times10^{-11}\times n_s^3 + 3.04657\times10^{-7}\times n_s^2 - 6.32312\times10^{-4}\times n_s + 0.4808,$$

wherein $n_s$ represents the specific speed of the rim-driven pump; and

S32: obtaining the blade solidity $s_g$ at the hub by the following formula:

$$s_g=(1.7-2.1)s_y.$$

Preferably, S4 specifically includes the following steps:

S41: obtaining an inlet setting angle $\beta_1$ and an outlet setting angle $\beta_2$ of each cylindrical section by the following formulas:

$$\begin{cases}\beta_1=\beta'_1+\Delta\beta_1\\ \beta_2=\beta'_2+\Delta\beta_2\end{cases};$$

wherein, $\beta'_1$ represents an inlet fluid flow angle, $$\beta'_1=\arctan\frac{v_m}{u},$$

wherein u represents a circumferential velocity, $v_m$ represents a blade inlet axial velocity, $$v_m=\frac{4Q}{\pi(D^2-d^2)\eta_v\varphi},$$

wherein $\varphi$ represents a blade displacement coefficient, $\pi$ represents the ratio of a circle's circumference to its diameter, $\eta_v$ represents volumetric efficiency of the pump, D represents the outer diameter of the impeller with the small hub-tip ratio, and d represents the diameter of the hub of the impeller with the small hub-tip ratio; $\Delta\beta_1$ represents an inlet angle of attack; $\beta'_2$ represents an outlet fluid flow angle;

$$\beta'_2=\arctan\frac{v_m}{u-v_{u2}},$$

wherein $v_{u2}$ represents a component of an absolute velocity along a circumferential direction, and $$v_{u2}=\xi\frac{gH}{u\eta_h},$$

wherein $\eta_h$ represents hydraulic efficiency of the pump, $\xi$ represents a correction coefficient, g represents the gravitational acceleration, and H represents the head; and $\Delta\beta_2$ represents an outlet angle of attack;

S42: obtaining the airfoil setting angle $\beta_L$ of each cylindrical section by the following formula:

$$\beta_L=(\beta_1+\beta_2)/2.$$

Preferably, the correction in S5 is performed by the following process:

obtaining the value of the inlet setting angle $\beta_1$ of each of the m cylindrical sections by the formula in S41, selecting three cylindrical sections closest to the rim, and fitting the diameter of each of the three cylindrical sections with the value of the corresponding inlet setting angle $\beta_1$ to obtain a quadratic polynomial as follows:

$$y_1=a_1x^2+b_1x+c_1;$$

wherein, $y_1$ represents the inlet setting angle $\beta_1$, x represents the diameter of the cylindrical section, and $a_1$, $b_1$ and $c_1$ all represent constants;

substituting the diameter of each of the $1^{st}$ cylindrical section to the $m^{th}$ cylindrical section into the quadratic polynomial to obtain a corrected value of the inlet setting angle $\beta_1$ of each of the $1^{st}$ cylindrical section to the $m^{th}$ cylindrical section; obtaining the value of the outlet setting angle $\beta_2$ of each of the m cylindrical sections by the formula in S41, selecting three cylindrical sections closest to the rim, and fitting the diameter of each of the three cylindrical sections with the value of the corresponding outlet setting angle $\theta_2$ to obtain a quadratic polynomial as follows:

$$y_2=a_2x^2+b_2x+c_2;$$

wherein, $y_2$ represents the outlet setting angle $\beta_2$, x represents the diameter of the cylindrical section, and $a_2$, $b_2$, and $c_2$ all represent constants;

substituting the diameter of each of the $1^{st}$ cylindrical section to the $m^{th}$ cylindrical section into the quadratic polynomial to obtain a corrected value of the outlet setting angle $\beta_2$ of the $1^{st}$ cylindrical section to the $m^{th}$ cylindrical section; and substituting the corrected value of the inlet setting angle $\beta_1$ and the corrected value of the outlet setting angle $\beta_2$ into the formula in S42 to obtain a corrected value of the airfoil setting angle $\beta_L$ of each cylindrical section.

Preferably, the thickness of the blade in S6 has a relatively small value when meeting the mechanical strength requirements. The thickness of the blade at the rim is 2 to 4 times the thickness of the blade at the hub, and the blades of the remaining part vary uniformly and smoothly in thickness.

The present invention further provides a rim-driven pump, including the impeller with the small hub-tip ratio obtained using the above design method.

The advantages of the present invention are as follows. The impeller with the small hub-tip ratio of the present invention is structurally reasonable and exhibits excellent hydraulic performance. In the present invention, the hub is reduced in size by approximately 64% and the outer diameter of the impeller is reduced by approximately 13% while meeting the flow rate and head requirements of the design working conditions, which significantly improves the flow capacity of the impeller.

DETAILED DESCRIPTION OF THE EMBODIMENTS

Figure 1:
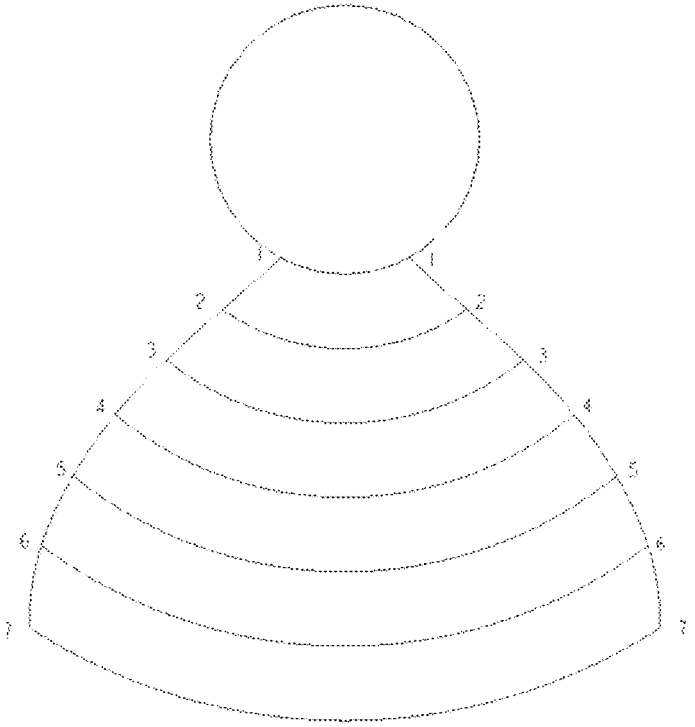
FIG. 1 is a structural schematic diagram of an embodiment of a blade of the impeller with the small hub-tip ratio.

The present invention will be described in detail with reference to the specific embodiments.

The hydraulic design parameters of the impeller with the small hub-tip ratio of the rim-driven pump include: the head H=2 m, the flow rate Q=270 $m^3$/h, the motor speed n=1450 r/min and the specific speed $n_s$=862.

S1: The outer diameter D of the impeller with the small hub-tip ratio is obtained by the following steps.

S11: The estimated value $D_{estimated\ value}$ of the outer diameter of the impeller with the small hub-tip ratio is obtained by the following formula:

$$D_{estimated\ value} = \frac{60}{n\pi}\left(\frac{n_s}{586} + 0.8\right)\sqrt{2gH} = 187.67\ \text{mm};$$

The estimated value $D_{estimated\ value}$ of the outer diameter of the impeller is rounded to 188 mm.

S12: The diameter d of the hub of the impeller with the small hub-tip ratio is obtained by the following formula:

$$d = R_d * D_{estimated\ value} = 37.6\ \text{mm}.$$

The diameter d of the hub is rounded to 38 mm.

S13: The actual value D of the outer diameter of the impeller with the small hub-tip ratio is obtained by the following formula:

$$D = \sqrt{\frac{\left(4Q + 0.07\pi d^2\sqrt[3]{Qn^2}\right)}{\left(0.07\pi\sqrt[3]{Qn^2}\right)}} = 163.27\ \text{mm}.$$

The actual value D of the outer diameter of the impeller with the small hub-tip ratio is rounded to 164 mm.

The outline dimension of the impeller is checked by the following formula:

$$1 - \frac{D}{D_{estimated\ value}} = 1 - \frac{164}{188} = 0.127 > 0.1.$$

Then D=164 mm and $d_h$=38 mm are used as the basic size parameters of the pump. Accordingly, $R_d = d_h/D_2 = 0.232$, which is between 0.1 and 0.3, belonging to the range of the small hub-tip ratio.

S2: The number of blades and the airfoil of the blade of the impeller with the small hub-tip ratio are determined as follows.

Excessive blades in the impeller with the small hub-tip ratio significantly intensify the displacement of the fluid by the blades at the hub. The number of blades is set as 3-5 and decreases with the increase of the specific speed $n_s$. The specific speed $n_s$=862 of the pump in the present embodiment belongs to the middle specific speed range. The number of blades is accordingly set as 4, and the blade airfoil adopts NACA4406 series airfoil.

S3: The blade solidity $s_y$ at the rim of the impeller with the small hub-tip ratio and the blade solidity $s_g$ at the hub of the impeller with the small hub-tip ratio are obtained by the following steps.

S31: The blade solidity $s_y$ at the rim is obtained by the following formula:

$$s_y = 6.1751k + 0.01254;$$

wherein, $$k = -5.0162\times10^{-11}\times n_s^3 + 3.04657\times10^{-7}\times n_s^2 - 6.32312\times10^{-4}\times n_s + 0.4808.$$

After calculation, $s_y$=0.8153.

An impeller with a small hub-tip ratio designed by the traditional design method is severely twisted in the vicinity of the hub and has a small chord length. Even the fluid at the hub flows in a direction opposite to the main flow direction, which cannot meet the design requirement. Therefore, the traditional calculation formula needs to be modified. The overall correction strategy is to increase the chord length of the impeller near the hub, and increase the blade solidity at the hub appropriately, so as to increase the outlet head near the hub without causing severe displacement.

S32: The blade solidity $s_g$ at the hub is obtained by the following formula:

$$s_g = (1.7 - 2.1)s_y;$$

wherein $s_g$ takes a larger value when the specific speed is high.

For the present embodiment, $s_g$=1.7 $s_y$ and $s_g$=1.3859.

The blade solidity at the remaining part increases uniformly from the rim to the hub in a linear fashion.

S4: The blades of the impeller with the small hub-tip ratio are divided into m cylindrical sections in an equidistant manner, the cylindrical sections are marked as 1-1, 2-2, . . . , m-m in sequence from the hub to the rim, and the airfoil setting angle $\beta_L$ of each of the cylindrical sections is obtained.

S41: The inlet setting angle $\beta_1$ and the outlet setting angle $\beta_2$ of each cylindrical section are obtained by the following formulas:

$$\begin{cases} \beta_1 = \beta_1' + \Delta\beta_1 \\ \beta_2 = \beta_2' + \Delta\beta_2 \end{cases};$$

wherein, $\beta'_1$ represents an inlet fluid flow angle, $$\beta_1' = \arctan\frac{v_m}{u},$$

wherein u represents a circumferential velocity, $v_m$ represents a blade inlet axial velocity, $$v_m = \frac{4Q}{\pi(D^2 - d^2)\eta_v\varphi},$$

wherein $\varphi$ represents a blade displacement coefficient, $\pi$ represents the ratio of a circle's circumference to its diameter, $\eta_v$ represents volumetric efficiency of the pump, D represents the outer diameter of the impeller with the small hub-tip ratio, and d represents the diameter of the hub of the impeller with the small hub-tip ratio; $\Delta\beta_1$ represents an inlet angle of attack; $\beta'_2$ represents an outlet fluid flow angle;

$$\beta_2' = \arctan\frac{v_m}{u - v_{u2}},$$

wherein $v_{u2}$ represents a component of an absolute velocity along a circumferential direction, and $$v_{u2} = \xi \frac{gH}{u\eta_h},$$

wherein $\eta_h$ represents hydraulic efficiency of the pump, $\xi$ represents a correction coefficient, g represents the gravitational acceleration, and H represents the head; and $\Delta\beta_2$ represents an outlet angle of attack.

S42: The airfoil setting angle $\beta_L$ of each cylindrical section is obtained by the following formula:

$$\beta_L=(\beta_1+\beta_2)/2.$$

The value of the inlet setting angle $R_1$ of each of the $1^{st}$ cylindrical section to the $m^{th}$ cylindrical section is obtained by the formula in S41, three cylindrical sections closest to the rim are selected, and the diameter of each of the three cylindrical sections is fitted with the value of the corresponding inlet setting angle $\beta_1$ to obtain a quadratic polynomial as follows:

$$y_1=a_1x^2+b_1x+c_1;$$

wherein, $y_1$ represents the inlet setting angle $\beta_1$, x represents the diameter of the cylindrical section, and $a_1$, $b_1$ and $c_1$ all represent constants.

The diameter of each of the $1^{st}$ cylindrical section to the $m^{th}$ cylindrical section is substituted into the quadratic polynomial to obtain a corrected value of the inlet setting angle $\beta_1$ of each of the $1^{st}$ cylindrical section to the $m^{th}$ cylindrical section.

The value of the outlet setting angle $\beta_2$ of each of the $1^{st}$ cylindrical section to the $m^{th}$ cylindrical sections is obtained by the formula in S41, three cylindrical sections closest to the rim are selected, and the diameter of each of the three cylindrical sections is fitted with the value of the corresponding outlet setting angle $\beta_2$ to obtain a quadratic polynomial as follows:

$$y_2=a_2x^2+b_2x+c_2;$$

wherein, $y_2$ represents the outlet setting angle $\beta_2$, x represents the diameter of the cylindrical section, and $a_2$, $b_2$, and $c_2$ all represent constants.

The diameter of each of the $1^{st}$ cylindrical section to the $m^{th}$ cylindrical section is substituted into the quadratic polynomial to obtain a corrected value of the outlet setting angle $\beta_2$ of the $1^{st}$ cylindrical section to the $m^{th}$ cylindrical section.

The corrected value of the inlet setting angle $\beta_1$ and the corrected value of the outlet setting angle $\beta_2$ are substituted into the formula in S42 to obtain a corrected value of the airfoil setting angle $\beta_L$ of each cylindrical section.

The value of m in the present embodiment is set as 7.

The value of the inlet setting angle $\beta_1$ of each cylindrical section is obtained by the formula in S41, wherein the inlet setting angle $\beta_1$ of section 1-1 is 57.83, the inlet setting angle $\beta_1$ of section 2-2 is 44.90, the inlet setting angle $\beta_1$ of section 3-3 is 36.31, the inlet setting angle $\beta_1$ of section 4-4 is 30.54, the inlet setting angle $\beta_1$ of section 5-5 is 26.57, the inlet setting angle $\beta_1$ of section 6-6 is 23.78, and the inlet setting angle $\beta_1$ of section 7-7 is 21.83.

The inlet setting angles $\beta_1$ of section 4-4, section 5-5, and section 6-6 are used as the dependent variable y, and the diameters of the corresponding section are used as the independent variable x to perform fitting to obtain the following formula:

$$y=59.25-0.38x+0.00095x^2.$$

According to the above formula, a correction is performed on the value of the inlet setting angle $\beta_1$ of each cylindrical section to obtain a corrected value, wherein the corrected value of $\beta_1$ of section 1-1 is 46.05, the corrected value of $\beta_1$ of section 2-2 is 39.93, the corrected value of $\beta_1$ of section 3-3 is 34.64, the corrected value of $\beta_1$ of section 4-4 is 30.19, the corrected value of $\beta_1$ of section 5-5 is 26.57, the corrected value of $\beta_1$ of section 6-6 is 23.78, and the corrected value of $\beta_1$ of section 7-7 is 21.83.

The value of the outlet setting angle 2 of each cylindrical section is obtained by the formula in S41, wherein the inlet setting angle $\beta_2$ of section 1-1 is −46.56, the inlet setting angle $\beta_2$ of section 2-2 is −85.37, the inlet setting angle $\beta_2$ of section 3-3 is 61.96, the inlet setting angle $\beta_2$ of section 4-4 is −43.99, the inlet setting angle $\beta_2$ of section 5-5 is 34.14, the inlet setting angle $\beta_2$ of section 6-6 is 28.18, and the inlet setting angle $\beta_2$ of section 7-7 is 24.30.

The outlet setting angles $\beta_2$ of section 4-4, section 5-5, and section 6-6 are used as the dependent variable y, and the diameters of the corresponding section are used as the independent variable x to perform fitting to obtain the following formula:

$$y=109.89-0.91x+0.0024x^2.$$

According to the above formula, a correction is performed on the value of the outlet setting angle $\beta_2$ of each cylindrical section to obtain a corrected value, wherein the corrected value of $\beta_2$ of section 1-1 is 48.77, the corrected value of $\beta_2$ of section 2-2 is 64.49, the corrected value of $\beta_2$ of section 3-3 is 52.30, the corrected value of $\beta_2$ of section 4-4 is 42.18, the corrected value of $\beta_2$ of section 5-5 is 34.14, the corrected value of $\beta_2$ of section 6-6 is 28.18, and the corrected value of $\beta_2$ of section 7-7 is 24.30.

The corrected value of the inlet setting angle $\beta_1$ and the corrected value of the outlet setting angle $\beta_2$ are substituted into the formula in S42 to obtain a corrected value of the airfoil setting angle $\beta_L$ of each cylindrical section, wherein the corrected value of $\beta_L$ of section 1-1 is 62.41, the corrected value of $\beta_L$ of section 2-2 is 52.21, the corrected value of $\beta_L$ of section 3-3 is 43.37, the corrected value of $\beta_L$ of section 4-4 is 36.19, the corrected value of $\beta_L$ of section 5-5 is 30.36, the corrected value of $\beta_L$ of section 6-6 is 25.98, and the corrected value of $\beta_L$ of section 7-7 is 23.07.

S6: The thickness of the blade of the impeller with the small hub-tip ratio is determined.

Since the rotational torque generated by the rim-driven pump is transmitted from the rim, and the amount of work done on the fluid at the rim is large, in consideration of the characteristics of the impeller of the rim-driven pump, the blades at the rim are thicker and the blades at the hub are thinner, and the thickness of the blades at the rim is 2 to 4 times that at the hub. In the present embodiment, the maximum thickness of the blade at the rim is 10 mm, and the maximum thickness of the blade at the hub is 5 mm, which is thickened according to the NACA4406 airfoil.

Figure 2:
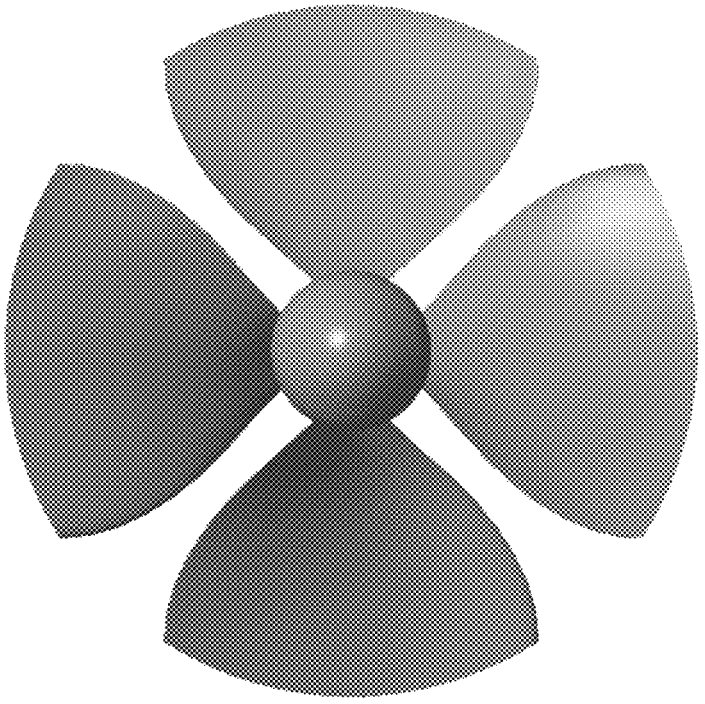
FIG. 2 is a three-dimensional view of the blades of the impeller with the small hub-tip ratio.

S7: The above method is verified via the computational fluid dynamics (CFD) technology. Firstly, the hydraulic model of the impeller with the small hub-tip ratio designed according to the above design method is two-dimensionally designed via computer-aided design (CAD). Then, the designed hydraulic model is imported into a three-dimensional design software to generate a three-dimensional impeller entity (as shown in FIG. 2). On this basis, the three-dimensional impeller entity is further processed to obtain a three-dimensional computing entity. After that, the processed model is imported into the meshing software ANSYS ICEM for meshing. Finally, a numerical simulation is performed via the fluid mechanics analysis software ANSYS CFX or ANSYS FLUENT, wherein the calculation method and boundary conditions are set as follows.

The governing equation of a three-dimensional incompressible fluid is discretized by the finite volume method. The governing equations of the three-dimensional turbulence numerical simulation include a cavitation model based on a two-phase flow mixing model, Reynolds-averaged Navier-Stokes (RANS) equations, and a shear stress transport (SST) k-ω turbulence model suitable for fluid separation. The governing equation is discretized by a control volume method, and has a diffusion term in a central difference scheme and a convection term in a second-order upwind scheme. The equations are solved using a separation and semi-implicit pressure coupling algorithm. The inlet boundary condition adopts the total pressure inlet, and the outlet boundary condition adopts the mass flow outlet. The wall function adopts a non-slip wall. The reference pressure is 0 Pa. The energy transfer between the rotating part (impeller) and the stationary part (guide vane) is realized by the "Frozen Rotor" approach. The calculation convergence criterion is set to 105, and the medium is 250 water.

Figure 3:
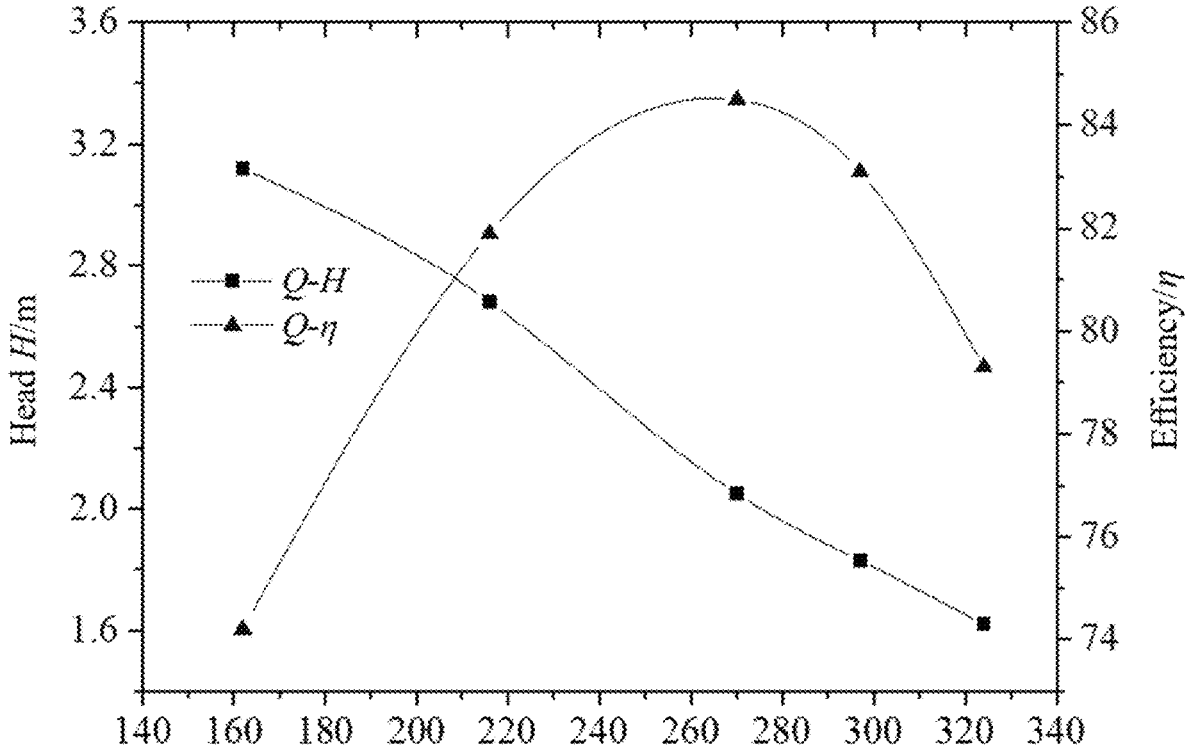
FIG. 3 schematically shows the flow rate Q versus head H curve and the flow rate Q versus efficiency $\eta$ curve of the numerical simulation of the impeller with the small hub-tip ratio.

The calculation results are analyzed as follows:

FIG. 3 schematically shows the flow rate Q versus head H curve and the flow rate Q versus efficiency η curve of the numerical simulation of the impeller with the small hub-tip ratio, which illustrates that the pump has a head of 2.05 m under design conditions. The comparison between the numerical simulation result and the design head $H_{des}$=2 m indicates that there is an error of 2.5%. This error falls within the engineering permissible range, which verifies the accuracy of the design method.

Figure 4:
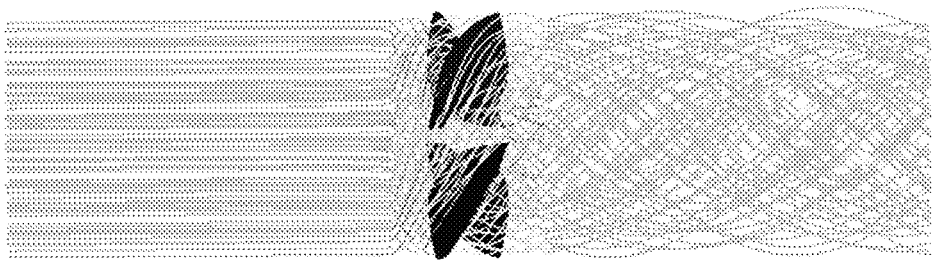
FIG. 4 is a velocity streamline diagram of the numerical simulation of the impeller with the small hub-tip ratio.

FIG. 4 is a velocity streamline diagram of the numerical simulation of the impeller with the small hub-tip ratio, which illustrates that before the fluid enters the impeller, the water flow is relatively uniform. After passing through the high-speed rotating impeller, the water continuously rotates to perform work. The water flow near the outlet is affected by the rotation of the impeller and executes a spiral motion. Overall, no obvious secondary backflow phenomenon occurs, good fluidity of the water is realized.

Figure 5:
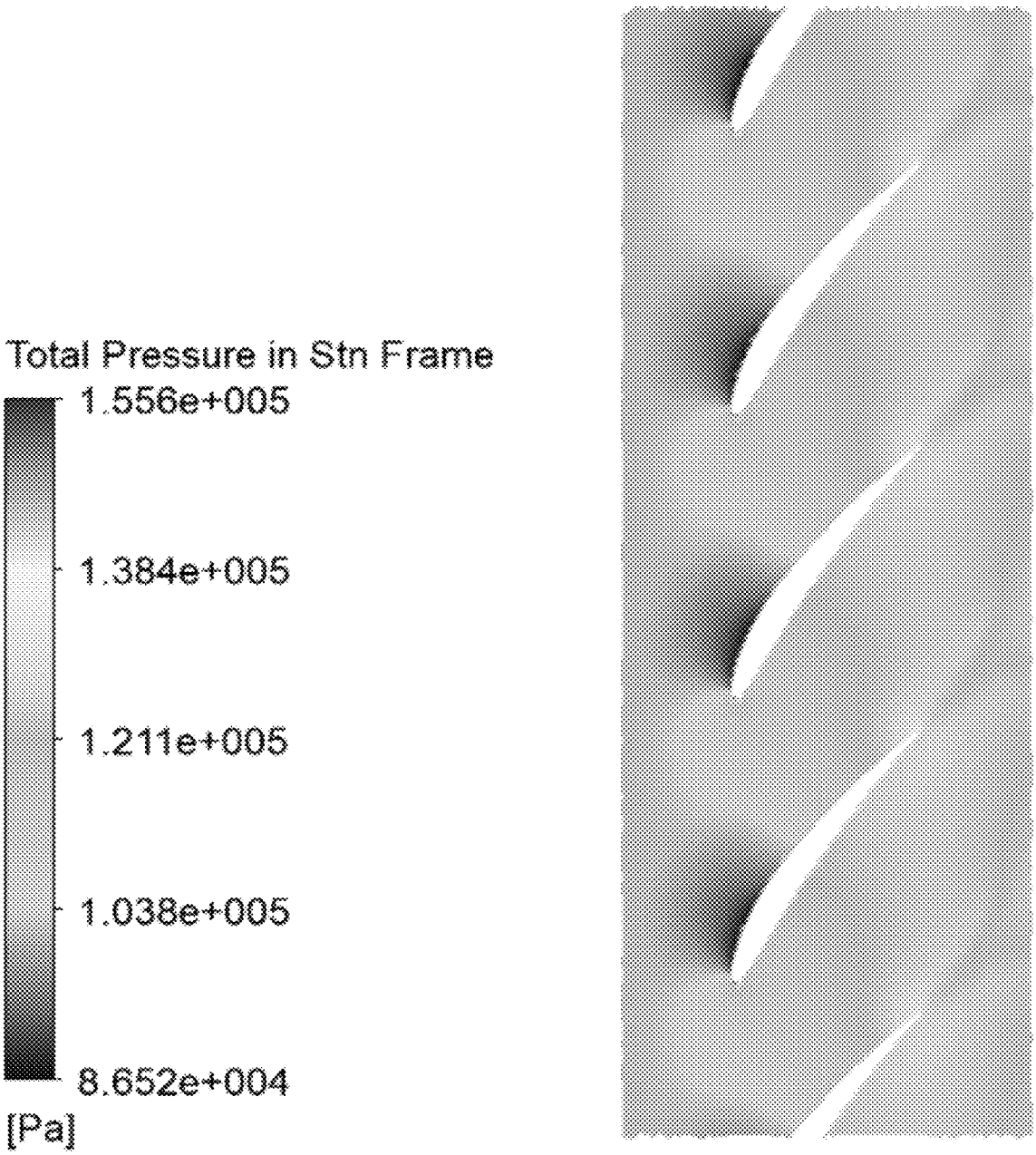
FIG. 5 is a schematic diagram showing the total pressure distribution at the middle section of the impeller blade.

FIG. 5 is a schematic diagram showing the total pressure distribution at the middle section of the impeller blade, which illustrates that, due to the rotation of the blade, a uniform low-pressure area appears at the blade inlet, and the pressure distribution at the blade outlet is relatively uniform.

Figure 6A:
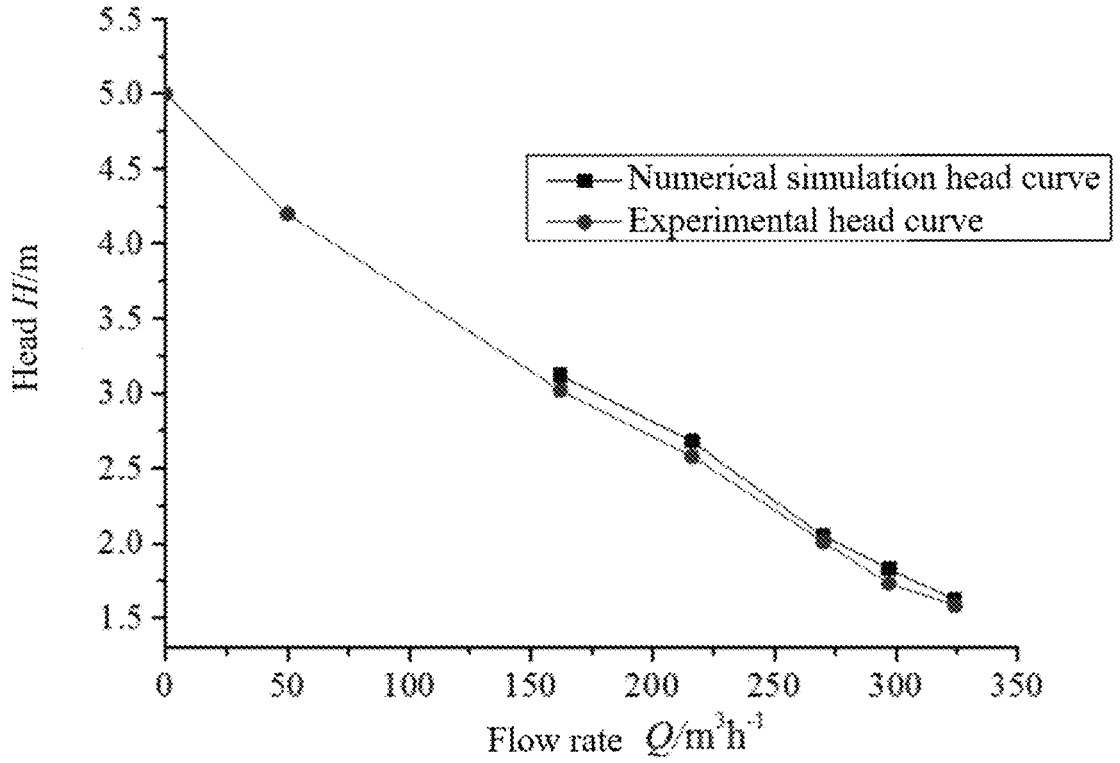
FIG. 6A is a graph showing the comparison between the head of the impeller with the small hub-tip ratio and the head of a model experiment.
Figure 6B:
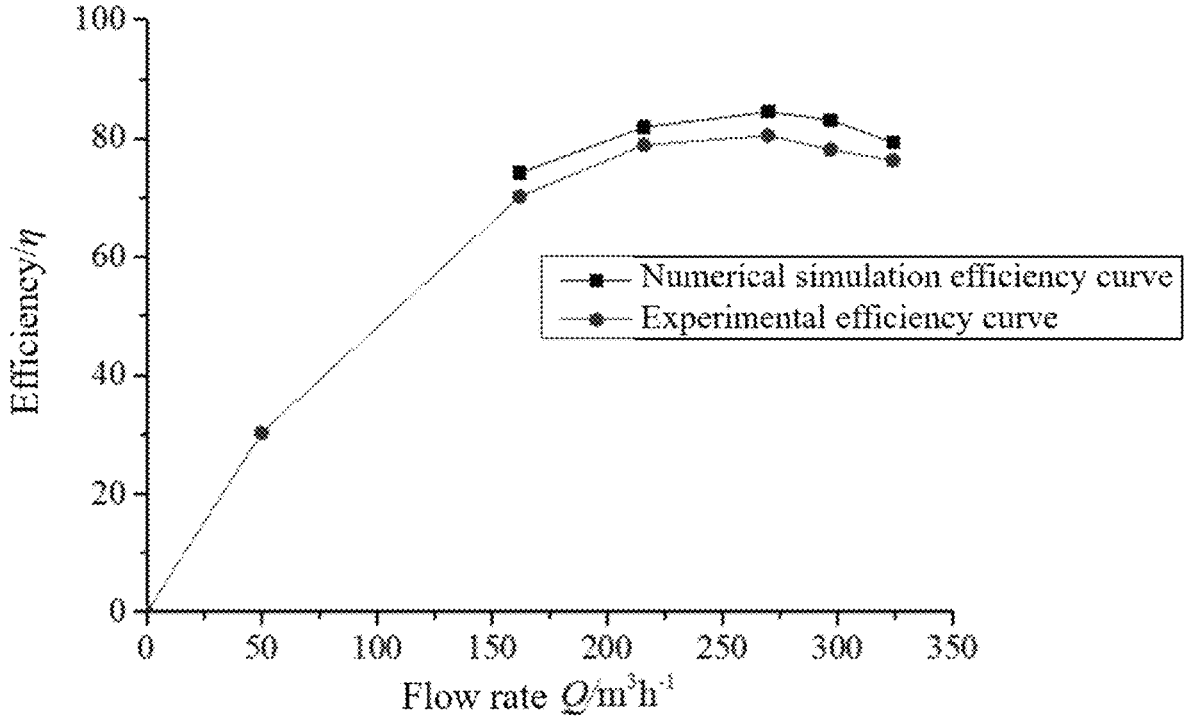
FIG. 6B is a graph showing the comparison between the efficiency of the impeller with the small hub-tip ratio and the efficiency of a model experiment.

In order to further verify the accuracy of the method, the numerical simulation result and the model experiment result are compared and analyzed, as shown in FIGS. 6A and 6B. FIGS. 6A and 6B illustrate that at the design operating point, the experimental head $H_{exp}$ of the pump is 2.01 m. The comparison between the numerical simulation result and the model experimental result indicates an error of 1.99%. According to the comparison between the efficiency curves, it can be concluded that the numerical simulation efficiency is 84.5%, the model experiment efficiency is 80.7%, and the error thereof is only 4.7%. This indicates that the impeller obtained by the method for designing the impeller with the small hub-tip ratio can exactly meet the design requirements while the authenticity of the method is experimentally verified.

The above description is only the preferred embodiments of the present invention, and is not used to limit the present invention. Although the present invention has been described in detail with reference to the foregoing embodiments, those skilled in the art can still modify the technical solutions described in the foregoing embodiments, or make equivalent substitutions to some of the technical features. Any modification, equivalent substitution, improvement, and the like made within the spirit and principle of the present invention shall fall within the scope of protection of the present invention.

What is claimed is:

1. A method for designing an impeller with a small hub-tip ratio, comprising the following steps:

S1: obtaining an outer diameter of the impeller with the small hub-tip ratio;

S2: determining a number of blades of the impeller with the small hub-tip ratio and an airfoil of each blade of the blades of the impeller with the small hub-tip ratio;

S3: obtaining a blade solidity $s_y$ at a rim of the impeller with the small hub-tip ratio and a blade solidity $s_g$ at a hub of the impeller with the small hub-tip ratio;

S4: dividing the blades of the impeller with the small hub-tip ratio into m cylindrical sections in an equidistant manner, marking the m cylindrical sections as 1-1, 2-2, . . . , m-m in sequence from the hub to the rim, and obtaining an airfoil setting angle $\beta_L$ of each cylindrical section of the m cylindrical sections;

S5: performing a correction on a value of the airfoil setting angle $\beta_L$ in S4;

S6: determining a thickness of the each blade of the impeller with the small hub-tip ratio;

S7 building an impeller model according to the outer diameter, the number of the blades, the airfoil of the each blade, the blade solidity $s_y$, the blade solidity $s_g$, the airfoil setting angle $\beta_L$ and the thickness of the each blade, and performing a numerical simulation on the impeller model to obtain a simulated head value; wherein if the simulated head value is within a predetermined head value range, the impeller with the small hub-tip ratio is obtained; and if the simulated head value is outside the predetermined head value range, returning to S1 to recalculate the simulated head value until the simulated head value is within the predetermined head value range.

2. The method according to claim 1, wherein, S1 specifically comprises the following steps:

S11: obtaining an estimated value $D_{estimated\ value}$ of the outer diameter of the impeller with the small hub-tip ratio by the following formula:

$$D_{estimated\ value} = \frac{60}{n\pi}\left(\frac{n_s}{586} + 0.8\right)\sqrt{2gH};$$

wherein, n represents a motor speed, π represents a ratio of a circumference of a circle to a diameter of the circle, $n_s$ represents a specific speed of a rim-driven pump, g represents a gravitational acceleration, and H represents a head;

S12: obtaining a diameter d of the hub of the impeller with the small hub-tip ratio by the following formula:

$$d=R_d*D_{estimated\ value};$$

wherein, $R_d$ represents the small hub-tip ratio, and $D_{estimated\ value}$ represents the estimated value of the outer diameter of the impeller with the small hub-tip ratio obtained in S11;

S13: obtaining an actual value D of the outer diameter of the impeller with the small hub-tip ratio by the following formula:

$$D=\sqrt{\frac{\left(4Q+0.07\pi d^2\sqrt[3]{Qn^2}\right)}{\left(0.07\pi\sqrt[3]{Qn^2}\right)}};$$

wherein, Q represents a flow rate, n represents the motor speed, π represents the ratio of the circumference of the circle to the diameter of the circle, and d represents the diameter of the hub of the impeller with the small hub-tip ratio obtained in S12.

3. The method according to claim 2, wherein, the number of the blades in S2 is 3-5, and the airfoil of the each blade is a NACA series airfoil;

the actual value D of the outer diameter of the impeller with the small hub-tip ratio obtained in S13 is checked by the following formula:

$$D_{check}=1-\frac{D}{D_{estimated\ value}};$$

if $D_{check}$ is within a range of 0.1-0.3, $D_{check}$ belongs to a range of the small hub-tip ratio; and if $D_{check}$ is outside the range of 0.1-0.3, the outer diameter of the impeller with the small hub-tip ratio is recalculated and obtained by S11-S13.

4. The method according to claim 1, wherein, S3 specifically comprises the following steps:

S31: obtaining the blade solidity $s_y$ at the rim by the following formula:

$$s_y=6.1751k+0.01254;$$

wherein, $$k=-5.0162\times10^{-11}\times n_s^3+3.04657\times10^{-7}\times n_s^2-6.32312\times10^{-4}\times n_s+0.4808,$$

wherein $n_s$ represents a specific speed of a rim-driven pump; and

S32: obtaining the blade solidity $s_g$ at the hub by the following formula:

$$s_g=(1.7-2.1)s_y.$$

5. The method according to claim 1, wherein, S4 specifically comprises the following steps:

S41: obtaining an inlet setting angle $\beta_1$ of the each cylindrical section and an outlet setting angle $\beta_2$ of the each cylindrical section by the following formulas:

$$\begin{cases}\beta_1=\beta_1'+\Delta\beta_1\\ \beta_2=\beta_2'+\Delta\beta_2\end{cases};$$

wherein, $\beta'_1$ represents an inlet fluid flow angle, $$\beta_1'=\arctan\frac{v_m}{u},$$

wherein u represents a circumferential velocity, $v_m$ represents a blade inlet axial velocity, $$v_m=\frac{4Q}{\pi(D^2-d^2)\eta_v\varphi},$$

wherein Q represents a flow rate, φ represents a blade displacement coefficient, π represents a ratio of a circumference of a circle to a diameter of the circle, $\eta_v$ represents a volumetric efficiency of a rim-driven pump, D represents an actual value of the outer diameter of the impeller with the small hub-tip ratio, and d represents a diameter of the hub of the impeller with the small hub-tip ratio; $\Delta\beta_1$ represents an inlet angle of attack; $\beta'_2$ represents an outlet fluid flow angle;

$$\beta_2'=\text{arc tan}\frac{v_m}{u-v_{u2}},$$

wherein $v_{u2}$ represents a component of an absolute velocity along a circumferential direction, and $$v_{u2}=\xi\frac{gH}{u\eta_h},$$

wherein u represents the circumferential velocity, $\eta_h$ represents a hydraulic efficiency of the rim-driven pump, ξ represents a correction coefficient, g represents a gravitational acceleration, and H represents a head; and $\Delta\beta_2$ represents an outlet angle of attack;

S42: obtaining the airfoil setting angle $\beta_L$ of the each cylindrical section by the following formula:

$$\beta_L=\beta_1+\beta_2)/2.$$

6. The method according to claim 5, wherein, the correction in S5 is performed by the following process:

obtaining a value of the inlet setting angle $\beta_1$ of the each cylindrical section by the formula $$\begin{cases}\beta_1=\beta_1'+\Delta\beta_1\\ \beta_2=\beta_2'+\Delta\beta_2\end{cases}$$

in S41, selecting three cylindrical sections of the m cylindrical sections, wherein the three cylindrical sections are adjacent to the rim, and fitting a diameter of each of the three cylindrical sections with the value of the inlet setting angle $\beta_1$ corresponding to each of the three cylindrical sections to obtain a first quadratic polynomial as follows:

$$y_1=a_1x^2+b_1x+c_1;$$

wherein, $y_1$ represents the inlet setting angle $\beta_1$, x represents the diameter of each of the three cylindrical sections, and $a_1$, $b_1$ and $c_1$ represent a first constant, a second constant and a third constant, respectively;

substituting the diameter of the each cylindrical section into the first quadratic polynomial to obtain a corrected value of the inlet setting angle $\beta_1$ of the each cylindrical section;

obtaining a value of the outlet setting angle $\beta_2$ of the each cylindrical section by the formula $$\begin{cases}\beta_1=\beta_1'+\Delta\beta_1\\ \beta_2=\beta_2'+\Delta\beta_2\end{cases}$$

in S41, and fitting the diameter of each of the three cylindrical sections with the value of the outlet setting angle $\beta_2$ corresponding to each of the three cylindrical sections to obtain a second quadratic polynomial as follows:

$$y_2=a_2x^2+b_2x+c_2;$$

wherein, $y_2$ represents the outlet setting angle $\beta_2$, x represents the diameter of each of the three cylindrical sections, and $a_2$, $b_2$, and $c_2$ represent a fourth constant, a fifth constant and a sixth constant, respectively;

substituting the diameter of the each cylindrical section into the second quadratic polynomial to obtain a corrected value of the outlet setting angle $\beta_2$ of the each cylindrical section; and substituting the corrected value of the inlet setting angle $\beta_1$ and the corrected value of the outlet setting angle $\beta_2$ into the formula $\beta_L=(\beta_1+\beta_2)/2$ in S42 to obtain a corrected value of the airfoil setting angle $\beta_L$ of the each cylindrical section.

7. The method according to claim 1, wherein, the thickness of the each blade in S6 has a predetermined value when meeting mechanical strength requirements; a thickness of the each blade at the rim is 2 to 4 times a thickness of the each blade at the hub, and a remaining part of the each blade varies uniformly and smoothly in thickness.

8. A rim-driven pump, comprising the impeller with the small hub-tip ratio obtained using the method according to claim 1.

9. The rim-driven pump according to claim 8, wherein, S1 specifically comprises the following steps:

S11: obtaining an estimated value $D_{estimated\ value}$ of the outer diameter of the impeller with the small hub-tip ratio by the following formula:

$$D_{estimated\ value}=\frac{60}{n\pi}\left(\frac{n_s}{586}+0.8\right)\sqrt{2gH};$$

wherein, n represents a motor speed, π represents a ratio of a circumference of a circle to a diameter of the circle, $n_s$ represents a specific speed of a rim-driven pump, g represents a gravitational acceleration, and H represents a head;

S12: obtaining a diameter d of the hub of the impeller with the small hub-tip ratio by the following formula:

$$d=R_d*D_{estimated\ value};$$

wherein, $R_d$ represents the small hub-tip ratio, and $D_{estimated\ value}$ represents the estimated value of the outer diameter of the impeller with the small hub-tip ratio obtained in S11;

S13: obtaining an actual value D of the outer diameter of the impeller with the small hub-tip ratio by the following formula:

$$D=\sqrt{\frac{\left(4Q+0.07\pi d^2\sqrt[3]{Qn^2}\right)}{\left(0.07\pi\sqrt[3]{Qn^2}\right)}};$$

wherein, Q represents a flow rate, n represents the motor speed, π represents the ratio of the circumference of the circle to the diameter of the circle, and d represents the diameter of the hub of the impeller with the small hub-tip ratio obtained in S12.

10. The rim-driven pump according to claim 9, wherein, the number of the blades in S2 is 3-5, and the airfoil of the each blade is a NACA series airfoil;

the actual value D of the outer diameter of the impeller with the small hub-tip ratio obtained in S13 is checked by the following formula:

$$D_{check}=1-\frac{D}{D_{estimated\ value}};$$

if $D_{check}$ is within a range of 0.1-0.3, $D_{check}$ belongs to a range of the small hub-tip ratio; and if $D_{check}$ is outside the range of 0.1-0.3, the outer diameter of the impeller with the small hub-tip ratio is recalculated and obtained by S11-S13.

11. The rim-driven pump according to claim 8, wherein, S3 specifically comprises the following steps:

S31: obtaining the blade solidity $s_y$ at the rim by the following formula:

$$s_y=6.1751k+0.01254;$$

wherein, $$k=-5.0162\times10^{-11}\times n_s^3+3.04657\times10^{-7}\times n_s^2-6.32312\times10^{-4}\times n_s+0.4808,$$

wherein $n_s$ represents a specific speed of a rim-driven pump; and

S32: obtaining the blade solidity $s_g$ at the hub by the following formula:

$$s_g=(1.7-2.1)s_y.$$

12. The rim-driven pump according to claim 8, wherein, S4 specifically comprises the following steps:

S41: obtaining an inlet setting angle $\beta_1$ of the each cylindrical section and an outlet setting angle $\beta_2$ of the each cylindrical section by the following formulas:

$$\begin{cases}\beta_1=\beta_1'+\Delta\beta_1\\ \beta_2=\beta_2'+\Delta\beta_2\end{cases};$$

wherein, $\beta'_1$ represents an inlet fluid flow angle, $$\beta_1'=\arctan\frac{v_m}{u},$$

wherein u represents a circumferential velocity, $v_m$ represents a blade inlet axial velocity, $$v_m=\frac{4Q}{\pi(D^2-d^2)\eta_v\varphi},$$

wherein Q represents a flow rate, φ represents a blade displacement coefficient, π represents a ratio of a circumference of a circle to a diameter of the circle, $\eta_v$ represents a volumetric efficiency of a rim-driven pump, D represents an actual value of the outer diameter of the impeller with the small hub-tip ratio, and d represents a diameter of the hub of the impeller with the small hub-tip ratio; $\Delta\beta_1$ represents an inlet angle of attack; $\beta'_2$ represents an outlet fluid flow angle;

$$\beta_2'=\arctan\frac{v_m}{u-v_{u2}},$$

wherein $v_{u2}$ represents a component of an absolute velocity along a circumferential direction, and $$v_{u2} = \xi \frac{gH}{u\eta_h},$$

wherein u represents the circumferential velocity, $\eta_h$ represents a hydraulic efficiency of the rim-driven pump, $\xi$ represents a correction coefficient, g represents a gravitational acceleration, and H represents a head; and $\Delta\beta_2$ represents an outlet angle of attack;

S42: obtaining the airfoil setting angle $\beta_L$ of the each cylindrical section by the following formula:

$$\beta_L=(\beta_1+\beta_2)/2.$$

13. The rim-driven pump according to claim 12, wherein, the correction in S5 is performed by the following process:

obtaining a value of the inlet setting angle $\beta_1$ of the each cylindrical section by the formula $$\begin{cases} \beta_1 = \beta_1' + \Delta\beta_1 \\ \beta_2 = \beta_2' + \Delta\beta_2 \end{cases}$$

in S41, selecting three cylindrical sections of the m cylindrical sections, wherein the three cylindrical sections are adjacent to the rim, and fitting a diameter of each of the three cylindrical sections with the value of the inlet setting angle $\beta_1$ corresponding to each of the three cylindrical sections to obtain a first quadratic polynomial as follows:

$$y_1=a_1x^2+b_1x+c_1;$$

wherein, $y_1$ represents the inlet setting angle $\beta_1$, x represents the diameter of each of the three cylindrical sections, and $a_1$, $b_1$ and $c_1$ represent a first constant, a second constant and a third constant, respectively;

substituting the diameter of the each cylindrical section into the first quadratic polynomial to obtain a corrected value of the inlet setting angle $\beta_1$ of the each cylindrical section;

obtaining a value of the outlet setting angle $\beta_2$ of the each cylindrical section by the formula $$\begin{cases} \beta_1 = \beta_1' + \Delta\beta_1 \\ \beta_2 = \beta_2' + \Delta\beta_2 \end{cases}$$

in S41, and fitting the diameter of each of the three cylindrical sections with the value of the outlet setting angle $\beta_2$ corresponding to each of the three cylindrical sections to obtain a second quadratic polynomial as follows:

$$y_2=a_2x^2+b_2x+c_2;$$

wherein, $y_2$ represents the outlet setting angle $\beta_2$, x represents the diameter of each of the three cylindrical sections, and $a_2$, $b_2$, and $c_2$ represent a fourth constant, a fifth constant and a sixth constant, respectively;

substituting the diameter of the each cylindrical section into the second quadratic polynomial to obtain a corrected value of the outlet setting angle $\beta_2$ of the each cylindrical section; and substituting the corrected value of the inlet setting angle $\beta_1$ and the corrected value of the outlet setting angle $\beta_2$ into the formula $\beta_L=(\beta_1+\beta_2)/2$ in S42 to obtain a corrected value of the airfoil setting angle $\beta_L$ of the each cylindrical section.

14. The rim-driven pump according to claim 8, wherein, the thickness of the each blade in S6 has a predetermined value when meeting mechanical strength requirements; a thickness of the each blade at the rim is 2 to 4 times a thickness of the each blade at the hub, and a remaining part of the each blade varies uniformly and smoothly in thickness.

* * * * *